US008387721B2

(12) United States Patent
Beach et al.

(10) Patent No.: US 8,387,721 B2
(45) Date of Patent: Mar. 5, 2013

(54) ORIENTATION HEAD

(75) Inventors: Andrew Beach, Boddington (AU); Gavin McLeod, Ardross (AU)

(73) Assignee: 2iC Australia Pty Ltd, Canning Vale (AU)

( * ) Notice: Subject to any disclaimer, the term of this patent is extended or adjusted under 35 U.S.C. 154(b) by 629 days.

(21) Appl. No.: 12/294,754

(22) PCT Filed: Mar. 27, 2007

(86) PCT No.: PCT/AU2007/000386

§ 371 (c)(1), (2), (4) Date: Mar. 17, 2010

(87) PCT Pub. No.: WO2007/109848

PCT Pub. Date: Oct. 4, 2007

(65) Prior Publication Data

US 2010/0230165 A1 Sep. 16, 2010

(30) Foreign Application Priority Data

Mar. 27, 2006 (AU) ..... 2006901550

(51) Int. Cl.
*E21B 25/16* (2006.01)

(52) U.S. Cl. ..... 175/44; 175/245

(58) Field of Classification Search ..... 175/44, 175/244, 245

See application file for complete search history.

(56) References Cited

U.S. PATENT DOCUMENTS

| | | | | |
|---|---|---|---|---|
| 1,769,152 | A * | 7/1930 | McLaughlin | 175/239 |
| 2002/0153168 | A1 * | 10/2002 | Hoop et al. | 175/20 |
| 2005/0034894 | A1 * | 2/2005 | Beach et al. | 175/44 |

FOREIGN PATENT DOCUMENTS

| | | |
|---|---|---|
| WO | WO 03/038232 | 8/2003 |
| WO | WO 2005/078232 | 8/2005 |

OTHER PUBLICATIONS

International Search Report from corresponding International Application No. PCT/AU2007/000386, filed Mar. 27, 2007.

Derwent Abstract Accession No. 94-215615/26, SU 1808985 A1 (Drilling Tech Res Inst) Apr. 15, 1993.

* cited by examiner

*Primary Examiner* — Brad Harcourt

(74) *Attorney, Agent, or Firm* — Wolf, Greenfield & Sacks, P.C.

(57) ABSTRACT

A core orientation head (12) comprises a substantially cylindrical body (28) having a first end (30) and an opposite end (34). A core face profile recording system (41) is carried by the body (28) to record a profile of the face of a core cut by a core drill in which the orientation head (12) is disposed. The system (41) comprises a plurality of pins (42) housed with an interference fit inside respective axially extending holes (38) provided in the body (28). A bearing scale (48) is marked on an outer circumferential surface 50 of the body (28). A cap (74) is demountably connectable to either of the ends (30) and (34). When connected to the end (30), the caps (74) protects the system (41). The caps (74) is also provided with a vernier scale (110) which, when the cap (74) is connected to the end (34), co-operates with the bearing scale (48) to facilitate marking of the core sample (46).

67 Claims, 11 Drawing Sheets

ORIENTATION HEAD

FIELD OF INVENTION

The present invention relates to an orientation head used to provide orientation data for a geological core sample.

BACKGROUND OF THE INVENTION

Core sampling is typically employed to allow geological surveying of the ground for the purposes of exploration and/or mining development. Analysis of the composition of the core sample provides information of the geological structure and composition of the surrounding ground. In order to maximize the usefulness of this information it is necessary to have knowledge of the orientation of the core sample relative to the ground from which it is cut.

Applicant has developed several core orientation devices which are in current commercial use. One device is known as the EZY-MARK system and is described in Applicant's international application number WO 2005/078232. The EZY-MARK system includes an orientation head which houses a plurality of pins used to locate profile points on a face of the core being cut. One or more rubber bands or O-rings are seated about the head which hold the pins in place in the absence of an axial force. When the orientation tool is lowered on to a toe of a hole, which forms a face of the core being cut, the pins slide into the head against the force applied by the O-rings to provide reference points that correlate to points on the core face. Once the core has been extracted, it can be aligned with the orientation tool by matching the points of the pins with the core face to enable orientation of the core. The core can then be marked with a pencil or other indelible marker at a location corresponding to the gravitational lowest point on the core.

SUMMARY OF THE INVENTION

According to one aspect of the present invention there is provided a core orientation head comprising:

- a body having first and second ends and being made of a non metallic material.

According to a second aspect of the present invention there is provided a core orientation head comprising:

- a body having first and second ends and an outer circumferential surface, the outer circumferential surface marked with a bearing scale.

According to a third aspect of the present invention there is provided a core orientation head comprising:

- a body having first and second ends and being made of a non metallic material, the body provided with a plurality of holes that open onto the first end of the body, the holes extending in a direction parallel to a longitudinal axis of the body; and,
- a plurality of pins which are slidably retained with an interference fit in respective holes.

According to a fourth aspect of the present invention there is provided a core orientation head comprising:

- a body having first and second opposite ends, and a core face profile recording device at the first end; and,
- a cap having a closed end and an opened end, the cap defining a cavity for receiving a portion of the body, the cap demountably connectable to either of the first and second ends of the body.

In this embodiment, the body may be provided with a first coupling mechanism at the first end of the body, and a second coupling mechanism at the second end of the body, and the cap is provided with third coupling mechanisms, the cap being demountably connectable to the first end of the body by engagement of the first and third coupling mechanisms, and demountably connectable to the second end of the body by engagement of the second and third coupling mechanisms.

When the body comprises the bearing scale, the cap is provided with a vernier scale providing one degree resolution of the bearing scale.

The body for the first and third aspect of the invention, above may be made from various materials including, but not limited to, plastics or rubber, for example NYLON and Polypropylene. However the body for the second and fourth aspects of the invention, above can be made of either non metallic or metallic materials or a combination of both.

BRIEF DESCRIPTION OF THE DRAWINGS

Embodiments of the present invention will now be described by way of example only with reference to the accompanying drawings in which.

DETAILED DESCRIPTION OF PREFERRED EMBODIMENT

Figure 1:
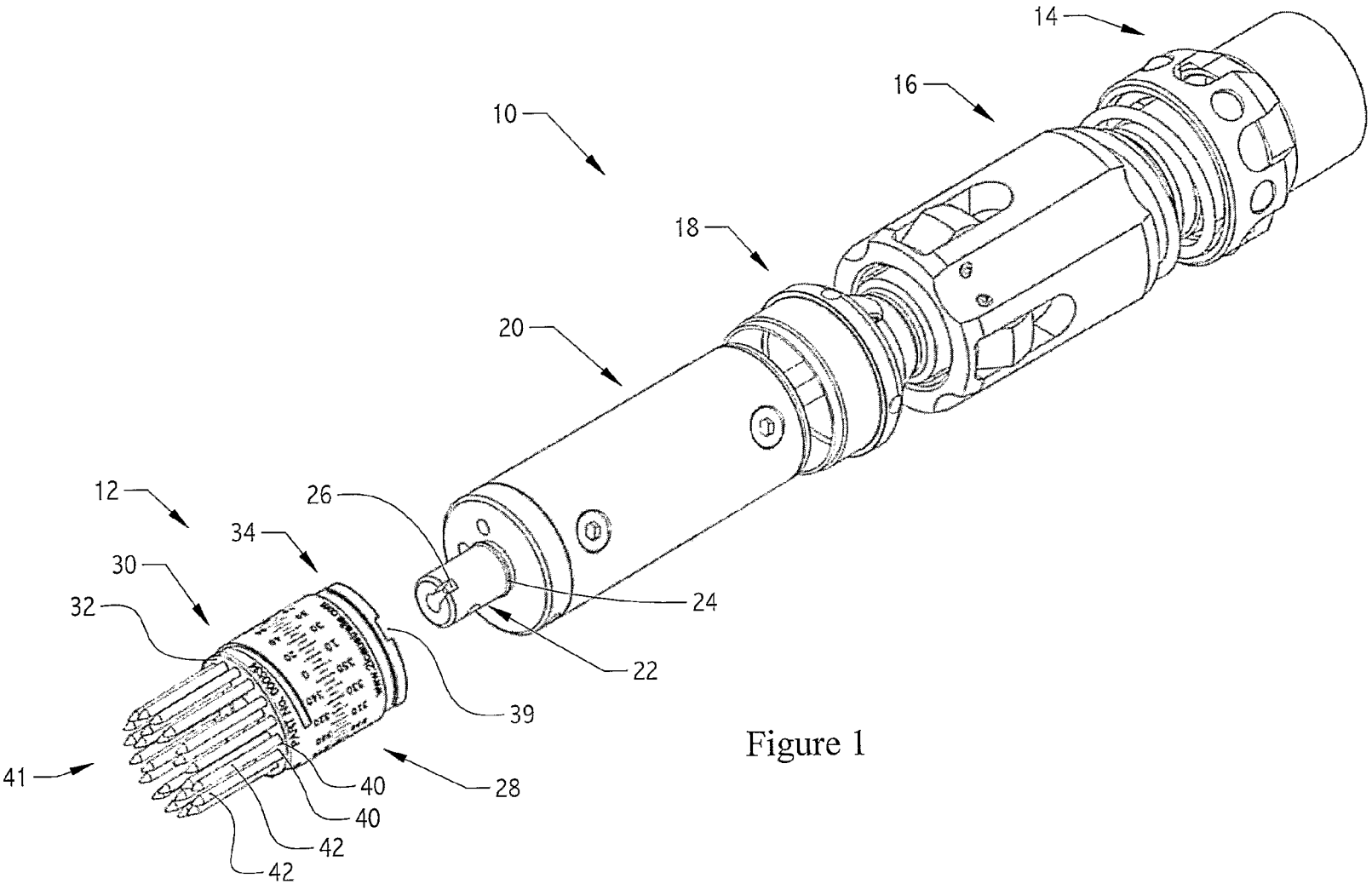
FIG. 1 is a partially exploded view of a core orientation tool comprising an embodiment of the present orientation head.

FIG. 1 depicts an orientation tool 10 which incorporates, as a detachable component, an embodiment of the orientation head 12. The tool comprises an anchor body 14, latch body 16, trigger body 18, and bottom orientator 20, examples of the construction and operation of which are described in Applicant's corresponding International Publication No. WO 2005/078232, the contents of which is incorporated herein by way of reference. Indeed, the overall operation of the tool 10 is in substance the same as that described in WO 2005/078232. The significant difference between the tool 10 and that in WO 2005/078232 is the form and configuration of the orientation head 12. The head 12 is demountably coupled to a shaft 22 extending axially from the bottom orientator 20. The shaft 22 includes a circumferential band 24 spaced a short distance from the bottom orientator 20. A small slot or keyway 26 is also formed at a free end of the shaft 22.

Figure 6:
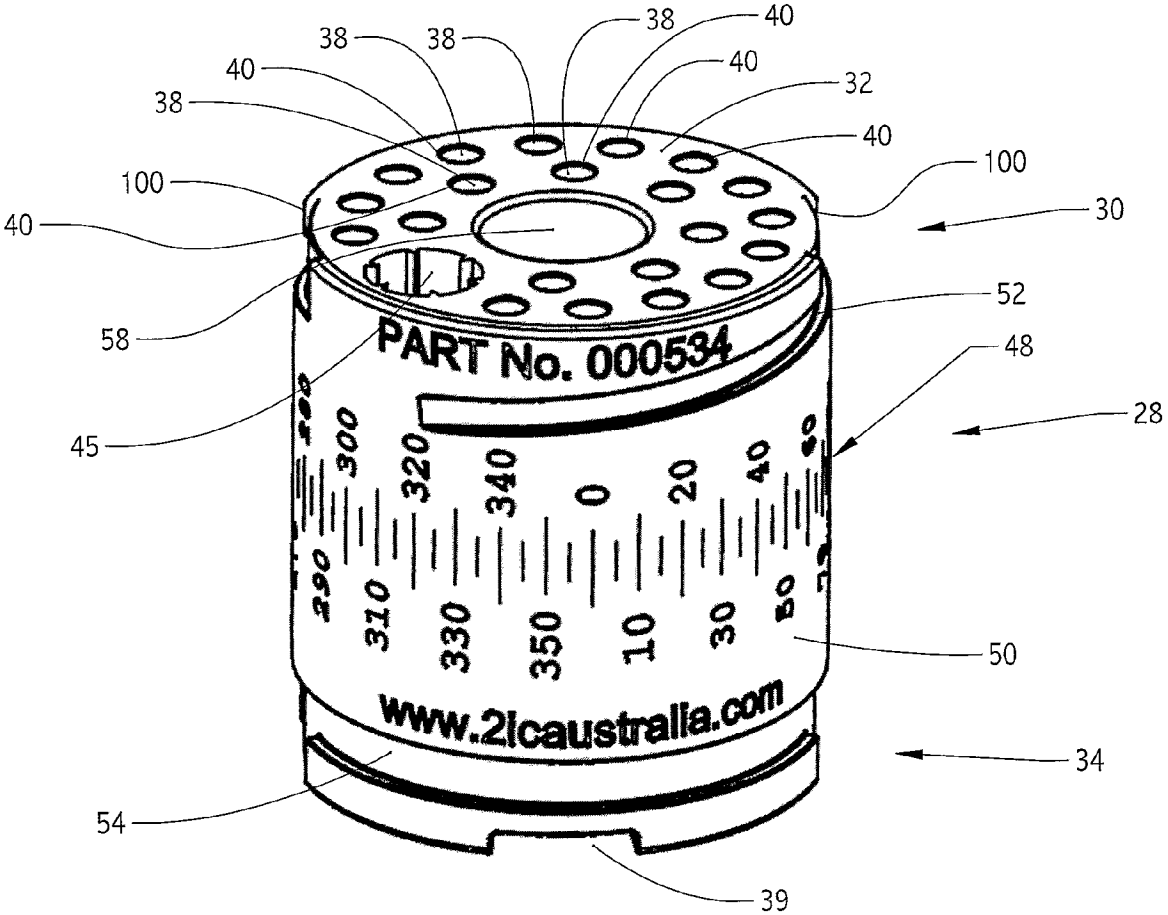
FIG. 6 is a perspective view of a body for a further embodiment of the orientation head depicted in FIG. 1-4.
Figure 7:
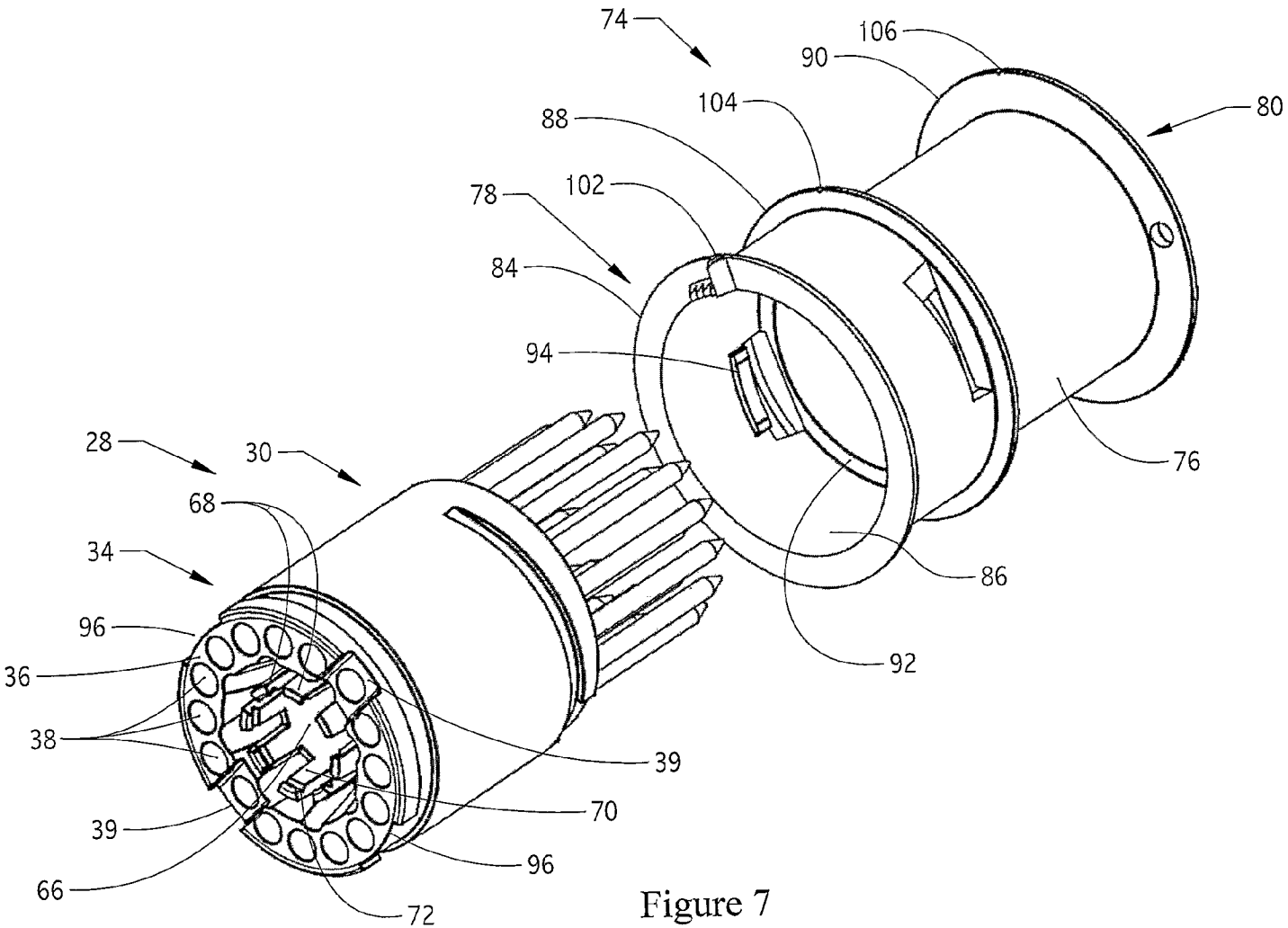
FIG. 7 is a perspective view of a cap used in conjunction with the orientation head.
Figure 8:
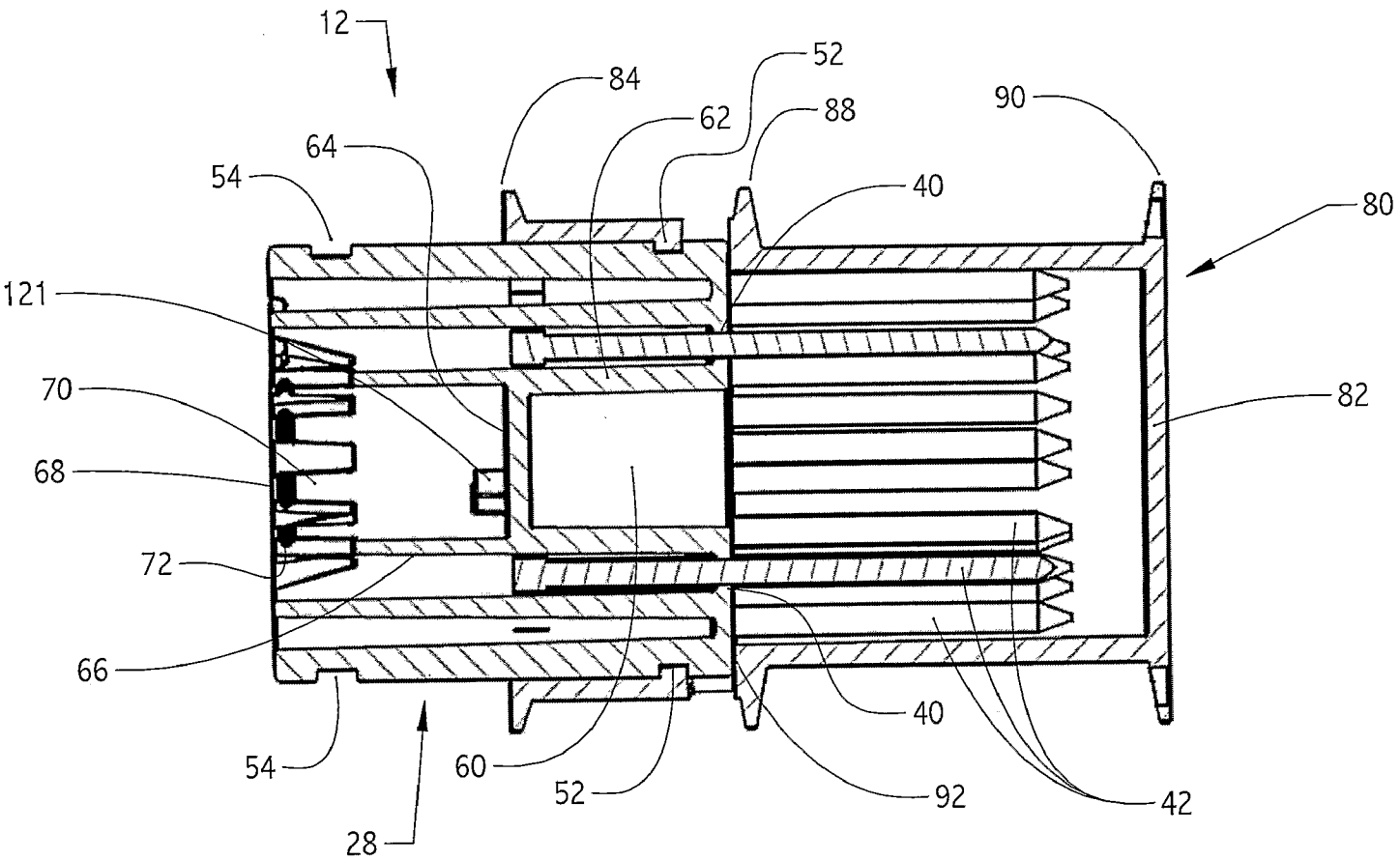
FIG. 8 is a section view of the orientation head and cap coupled in a first juxtaposition.

The orientation head 12 comprises a substantially cylindrical body 28 that in various embodiments of the invention may be made from non metallic materials such as plastics, or rubber. In such embodiments the material should have some degree of natural resilience. The body 28 has a first end 30 across which extends a radial face 32, and a second opposite end 34 at which is located an annular face 36. Referring to FIGS. 6-8 a plurality of holes or channels 38 extend axially through the body 28 and open onto both faces 32 and 36. The holes 38 are provided with a restriction or reduced diameter portion 40 at the face 32.

Cutouts 39 are provided at the end 34 to receive a screw driver blade or like implement to assist in decoupling the head 12 from the shaft 22 as explained in greater detail hereinafter.

The head 12 includes a core face profile recording system 41 carried by the body 28. In the present embodiment the system 41 comprises a set of pins 42 which are accommodated in the holes 38 and extend forward of the face 32 through the reduced diameter portions 40. The pins 42 and holes 38, and more particularly the restricted portions 40 of the holes 38 are relatively dimensioned to form an interference fit.

Figure 16:
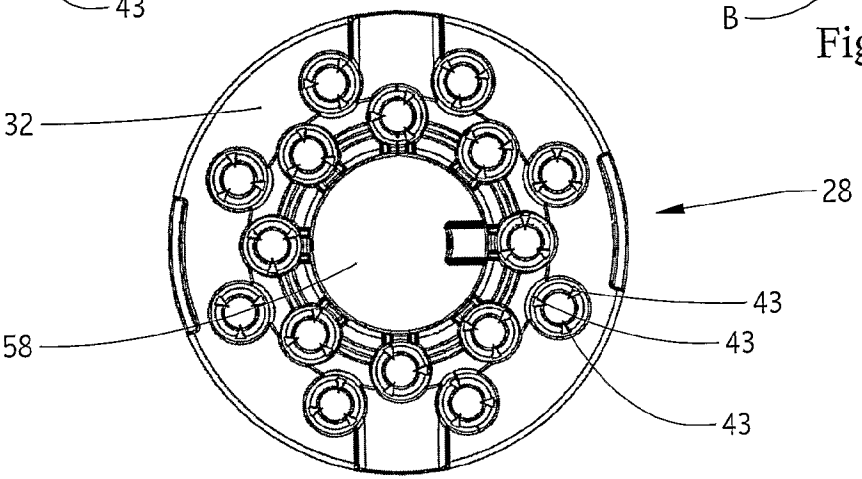
FIGS. 15 and 16 are section and end views of the body of an alternate embodiments of the head; and, FIG. 17 is a perspective view of a cap incorporated in an alternate embodiment of the head.
Figure 15:
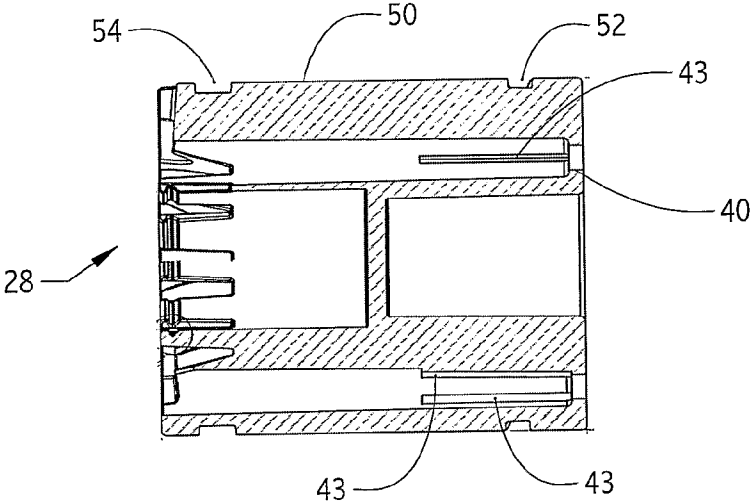

As an alternative or in addition to the interference fit provided by the portions 40, one or more axially extending ridges 43 (shown in FIGS. 15 and 16) may be formed running along a portion of the length of an inner surface of the holes 38 to create an interference fit with the pins 42. The interference fit between the pins 42 and holes 38 (i.e. the portions 40 and/or ridges 43) holds the pins 42 relative to the body 28 in the absence of a force acting in the axial direction of the pins 42. Thus, when the tool 10 is lowered onto a toe of a hole to be drilled, which eventually will form a core face 44 (see FIG. 4) of a core sample 46, the pins 42 will slide axially into the holes 38 by distance dependent upon the relative positions of the points of the core face 44 that the pins contact. In this way, the pins 42 provided a plurality of profile points, and thus form a profile record, of the core face 44. The position of the pins 42 is maintained by virtue of the interference fit between the holes 38 and pins 42.

The core face profile recording system may also include a marker such as a pencil (not shown) that can be accommodated in a hole 45 (see FIG. 6) formed in the body 28 and opening onto the end 30. The marker makes a visible mark on the core face to provide a reference point to assist with the rotational alignment of the core sample 46 with the profile record of the face 44 formed by the points of the pins 42. The visible mark on the core face may also provide a further, or indeed an alternate, indication for core face orientation.

With particular reference to FIG. 6, though as also shown in FIGS. 1-5 and 10-14, the body 28 is provided with a compass or bearing scale 48 about its outer circumferential surface 50. The scale 48 provides markings in 5° increments for 360°.

A first coupling mechanism in the form of a helical thread 52 is formed in the outer circumferential surface 50 near the first end 30. The helical thread 52 is depicted as extending less than one full revolution about the body 28 although in alternate embodiments the thread 52 may extend for several revolutions.

A second coupling mechanism in the form of a circumferential groove 54 is formed about the outer circumferential surface 50 near the second end 34.

Figure 9:
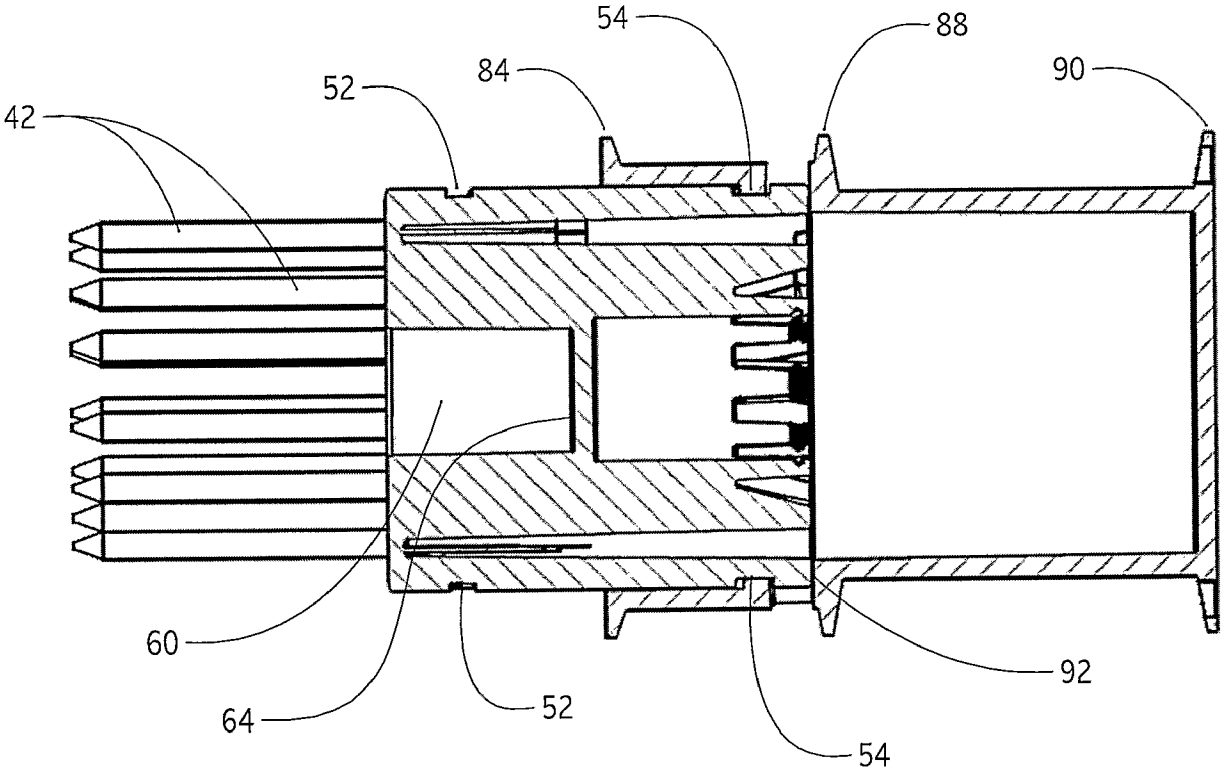
FIG. 9 is a section view of the body and the cap coupled in a second juxtaposition.

A central aperture 58 is formed in the face 32 leading to a void 60 (see in particular FIGS. 8 and 9) in the body 28. The void 60 is defined by a circumferential wall 62 and a radial wall 64 that extends across the circumferential wall 62 at a location approximately half way along the axial length of the body 28. The purpose of the void 60 is simply to reduce or minimize the amount of material required to manufacture the body 28.

Extending from the radial wall 64, coaxial with the circumferential wall 62 is a tubular portion 66 that terminates in a plurality of spaced apart fingers 68. A radially inner surface 70 of each finger 68 is provided with a circumferentially extending groove 72. As explained in greater detail below this constitutes an integrally formed releasable connector for attaching the head 12 to the tool 10.

The orientation head 12 also comprises a cap 74 (see FIG. 7-9) that can be demountably connected or coupled to either end 30 or 34 of the body 28. The cap is in the general form of a cylindrical tube 76 that is open at one end 78 and closed at an opposite end 80 by a radial wall 82. An annular flange 84 extends about the end 78 laterally outward of an inner circumferential surface 86 of the tube 76. Approximately one-third of the way along the tube 76 from the end 78 is a second annular flange 88. A further flange 90 is formed about the second end 80 and substantially co-planar with the radial wall 82.

The diameter of the inner circumferential surface 86 for the length of the tube 76 between the flanges 80 and 88 is smaller than the diameter of the inner circumferential surface 86 from the flange 88 to the flange 84. This change in diameter forms a circumferential seat 92 at a location adjacent the flange 88.

A pair of diametrically opposed partial helical thread sections or runners 94 (only one of which is visible in FIG. 7 but both of which can be seen in FIG. 9) are formed on the inner circumferential surface 86 between the flanges 88 and 84 and extend in a circumferential direction for a relatively short arc length of about 20°. In order to couple the cap 74 to end 34 of the body 28 the runners 94 pass through corresponding channels 96 formed in the outer surface 50 of the body 28 at the end 34. The channels 96 lead to the groove 54 in which the runners 94 are received. The groove 54 is sufficiently wide to accommodate both runners 94 simultaneously which are axially offset from each other due to their requirement to engage the thread 52.

In order to couple the cap 74 to end 30 of the body 28 the thread sections 94 pass through respective channels 100 (see FIG. 6) formed in the outer circumferential surface 50 at the end 30 of the body 28. The channels 100 lead to the partial helical thread 52.

Three alignment marks 102, 104 and 106 which lie on a common straight line are formed on the outer circumferential surface of the flanges 84, 88 and 90 respectively. The marks 102, 104, and 106 may be formed during or as part of the manufacture process of the cap in a number of different ways, for example by use of indelible ink or by scribing, cutting or moulding shallow notches or grooves in the flanges as is depicted in FIGS. 7 and 10-14. Further, the mark 102 extends along a major pointer P of a vernier scale 110 formed on the flange 84. The vernier scale also includes four minor spaced apart pointers 112, 114, 116 and 118. As described in greater detail below, the vernier scale 110 is used in conjunction with the scale 48 to locate a predetermined reference point such as the gravitational bottom or top of the core sample 46.

The operation of the orientation head 12 will now be described in detail.

The orientation head 12 is assembled by inserting the pins 42 into the holes 38 from the end 34 and extending them as far as possible from the first end 30. The pins 42 are held in position by virtue of the interference fit between the pins 42 and the reduced diameter portion 40 and/or the axial ridges 43 of the holes 38. Enlarged heads of pins 42 prevent them from being pulled out of the head 12 from end 30. The cap 74 is then screwed onto end 30 by engagement of the thread sections 94 with thread 52. This protects the pins 42 from being pushed back into the holes 38 as well as protecting users from possible injury.

The head 12 is releasably connected to the remainder of the tool 10 by a snap fit of the fingers 68 on the shaft 22. The snap fit is facilitated by the resilient spreading the fingers 68 radially outward over the band 24 on the shaft 22 and then springing radially inward as the grooves 72 align with the band 24. During this process the head 12 is rotated to locate a key 121 (shown in FIG. 8) on the head 12 with the keyway 26 on the shaft 22. This provides a rotational reference mechanism to relate the bottom of the hole indicated by the bottom orientation 20 to the core. The cap 74 is decoupled from the body 28 when the tool 10 is about to be used. The tool 10 is then used in the normal manner described in WO 2005/078232 so that the pins 42 are pushed back into the holes 38 to provide a plurality of profile points for the core face 44. As a tool 10 is withdrawn from a bore hole, the relative positions of the pins 42 is maintained by virtue of the above mentioned interference fit.

Figure 3:
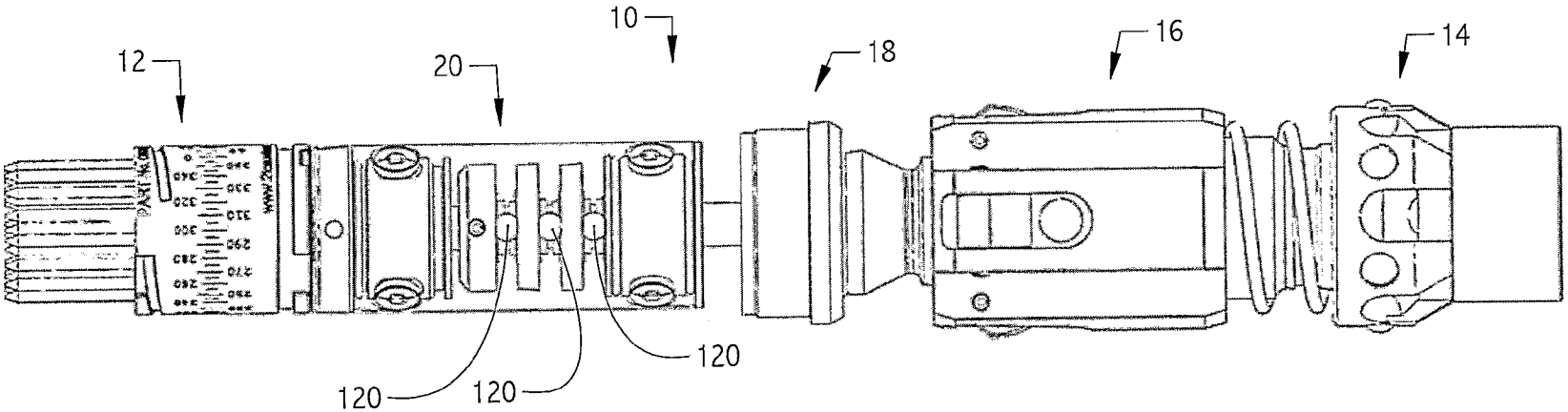
FIG. 3 is a side view of a second form of the orientation tool to which is coupled an identical embodiment of the orientation head depicted in FIGS. 1 and 2.
Figure 2:
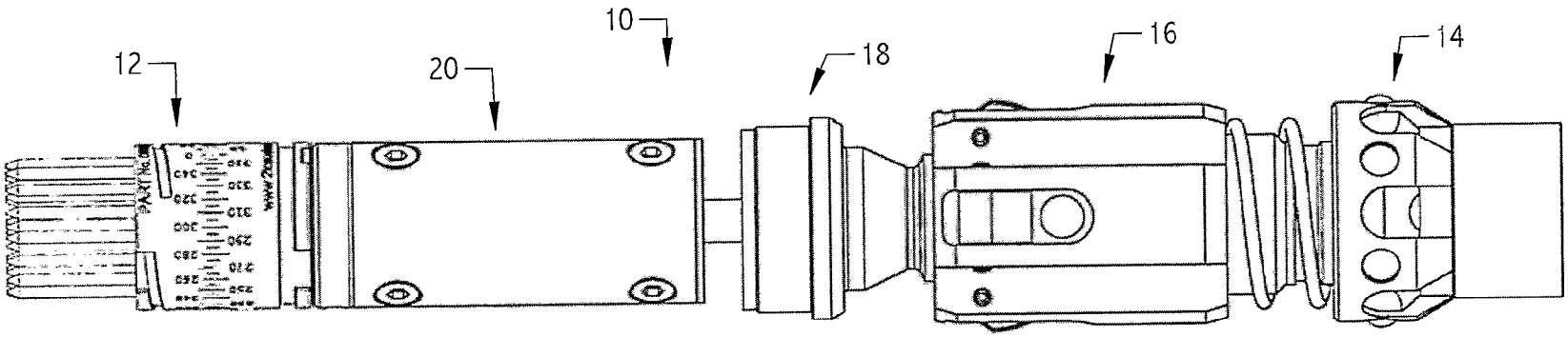
FIG. 2 is a side view of the orientation tool depicted in FIG. 1 with the orientation head coupled thereto.
Figure 4:
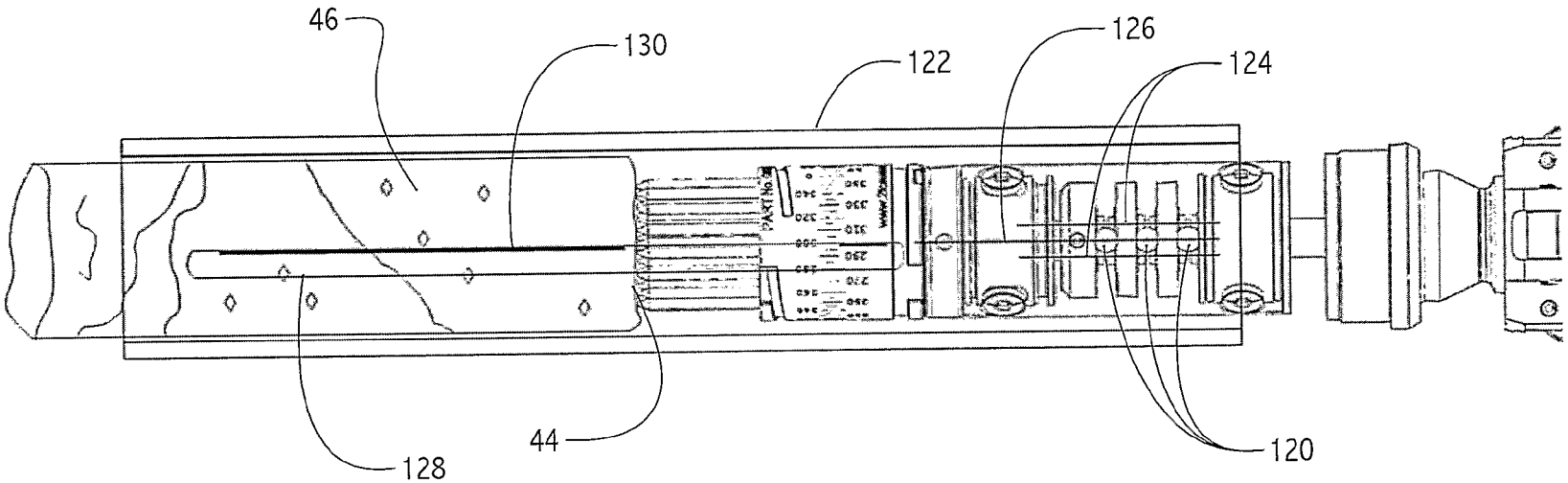
FIG. 4 illustrates a method of use of the orientation head and tool depicted in FIG. 3.
Figure 5:
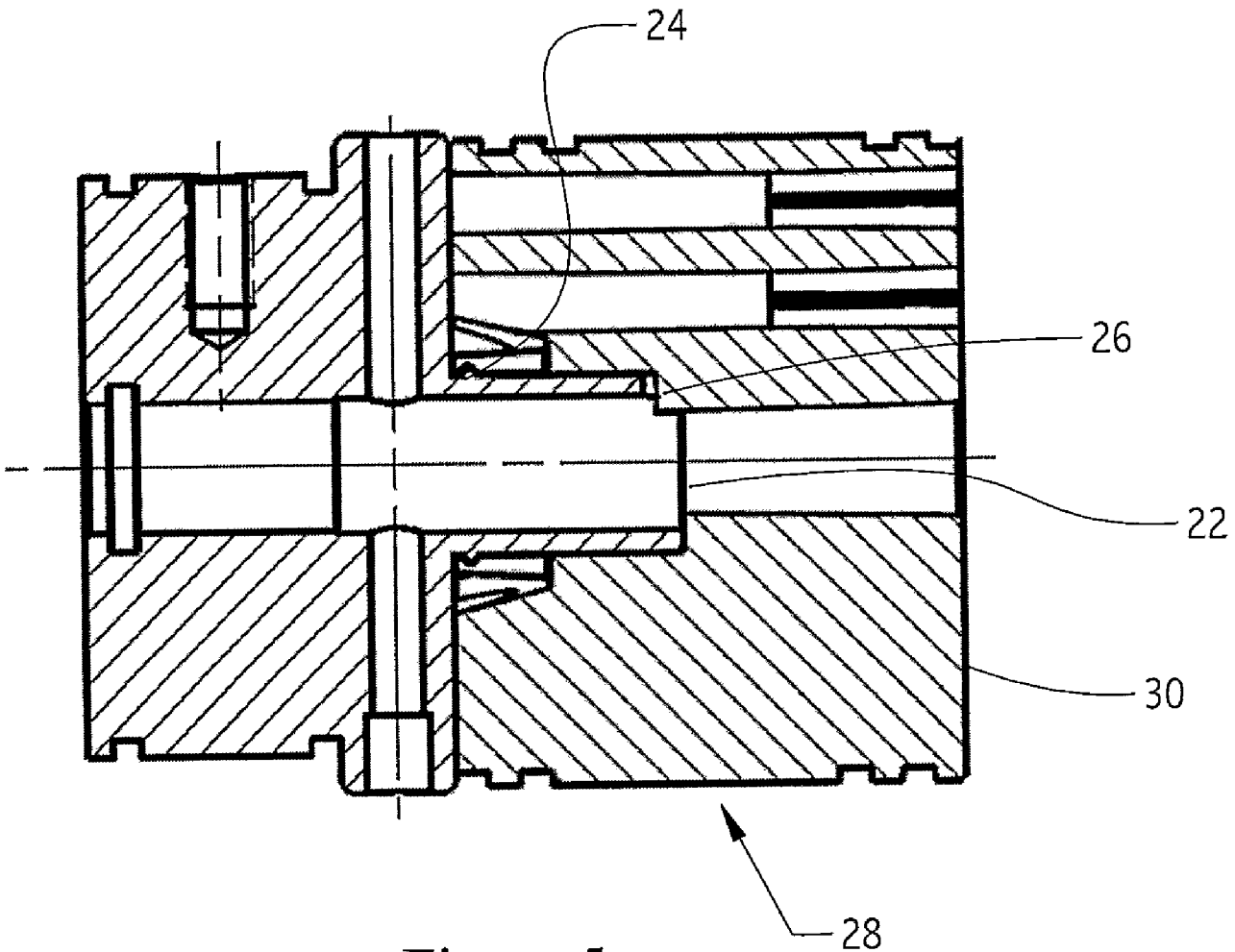
FIG. 5 is a sectional view through a portion of the head and tool depicted in FIGS. 2 and 3 and depicting a method of coupling of the orientation head to the orientation tool.

FIGS. 3 and 4 depict a mechanical type of bottom orientator 20 identical to that described in WO 2005/078232 which comprises a plurality of orientation balls 120. With the core sample 46 and the orientation tool 10 now retrieved from the bore hole and typically in a core tray, the tool 10 is orientated so that the orientation balls 120 are visible. Assuming the tool 10 has operated correctly, the balls 120 will be in alignment along a line corresponding to the gravitational bottom of the core sample 46. The core sample 46 is rotated until the profile of the face 44 matches the profile record formed by the points of the pins 42. A template 122 is then used to allow a geologist to draw a line on both the outer circumferential surface 50 of the body 28 as well as the core sample 46. Alternately the geologist or core logger can align the head 28 to the core sample 46 to mark the core at a later time. In this case the head 28 can be marked by aligning the template 122 to the balls without first aligning the core sample 46 to the head. To this end, the template 122 comprises a pair of parallel tram lines 124 for location on opposite sides of the orientation balls 120, and a pointer line 126 that extends parallel with and centrally between the tram lines 124. An elongate slot 128 is cut in the template 122 and has one edge 130 in alignment with the pointer line 126. The slot 128 extends over the scale 48 on the body 28 as well as over a portion of the length of the core sample 46. A geologist or other suitably qualified person using a marker such as a pen or pencil will now draws a line along the edge 130 from the body 28 across the scale 48 and along the core sample 46.

The cap 74 is engaged with the body 28 by engaging the thread sections 94 with the partial thread 52 at the first end 30 of the body 28. Due to the helical nature of the thread 52, when the cap 74 is screwed onto the first end 30 of the body 28 the seat 92 can be brought into tight and sealing contact with the face 32. This relative configuration of the body 28 and cap 74 is shown in FIG. 8. The pins 42 are now protected from being pushed inwards of the body 28 and thus maintain their relative juxtaposition and profile record of the core face 44. The head 12 can be pulled off the shaft 22. If required a screw driver or like implement can be used to assist in decoupling the head 12 from the shaft 22, by inserting an end of the screw driver into one of the cutouts 39 and levering the head 12 off. The orientation head 12 can now be used as a core block to accompany the corresponding core. Thus the orientation head 12 becomes a single use device.

Figure 11:
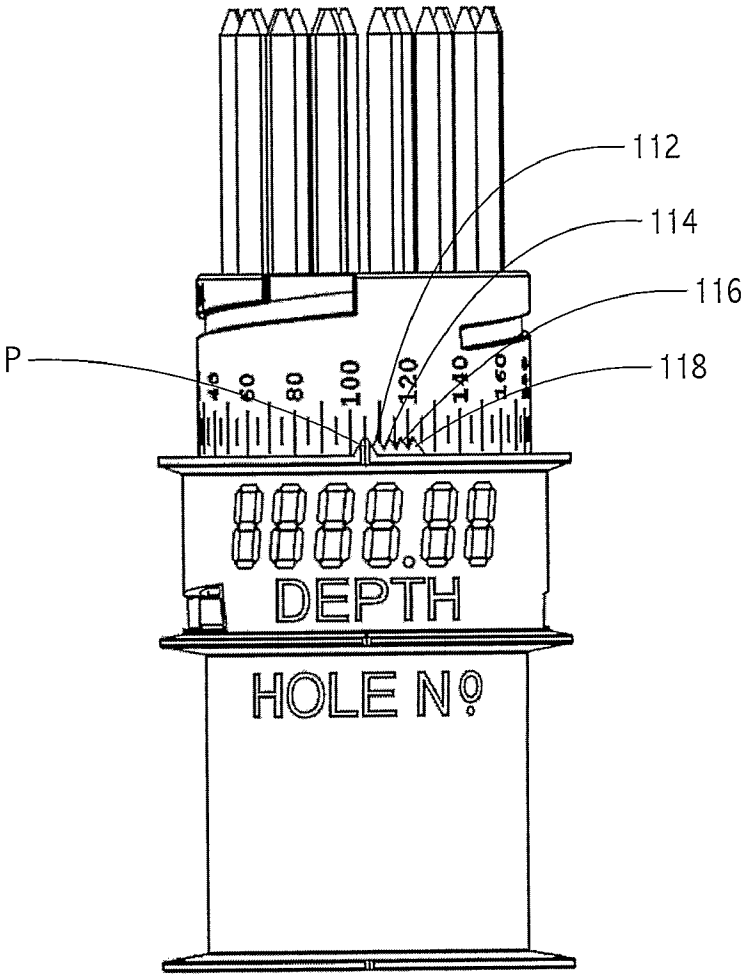
FIGS. 11-14 depict sequential steps for using a vernier scale incorporated in the cap.
Figure 10:
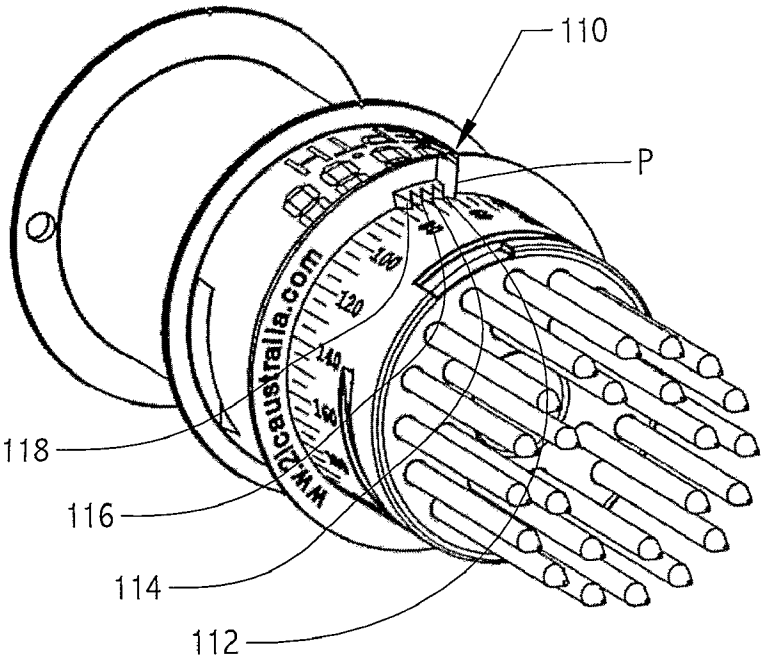
FIG. 10 is a perspective view of the orientation head and cap coupled in the second juxtaposition.
Figure 14:
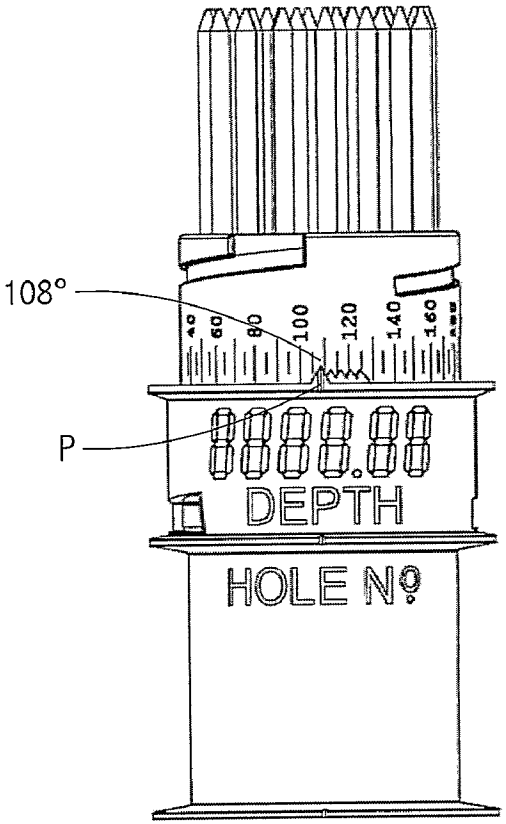

Information pertaining to the core such as hole depth and hole number may be transcribed on the cap 74. To this end, and as shown in FIG. 11, the outer surface of the cap 74 between the flanges 84 and 88 is provided with a plurality of representations of digital style "FIG. 8". This enables a geologist or rig operator to colour in various parts of each digital "FIG. 8" corresponding to the digits that comprise the hole depth. The hole number may be written by hand on a portion of the outer surface of the cap 74 between the flanges 88 and 90.

The removed orientation head 12 with the cap 74 forms a permanent record of the orientation of the corresponding core and may be used by geologists to confirm orientation of the core.

When the bottom orientator 20 of the orientation tool 10 is in the form of a digital device (ie electronic) rather than a mechanical device depicted in FIG. 3, the vernier scale 110 is used to indicate the location of the line to be drawn on the core sample 46 and body 28 representative of the location of the bottom of the core. The manner of use of the vernier scale 110 will be described by way of example with particular reference to FIGS. 11-14. Assume that the digital orientation device 20 indicates that the bottom of the hole is at a location of 108° from a reference point. The reference point coincides with the slot 26 on the shaft 22 that receives the key 121 in the head 12 and which in turn is aligned with the 0° mark on the scale 48. With the head 12 detached from the shaft 22 the cap 74 is now coupled to the second end 34 of the orientation head 12 by locating the thread section 94 in the groove 54. This allows the cap 74 to rotate relative to the body 28.

Figure 13:
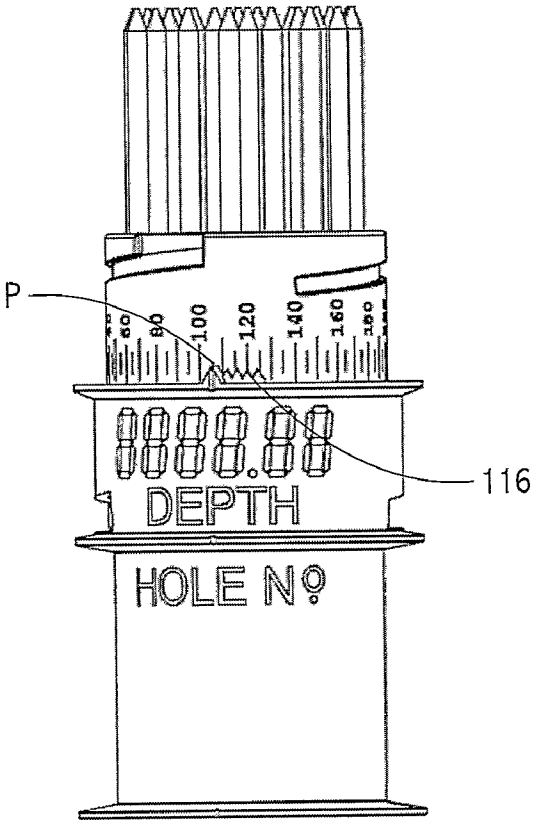
Figure 12:
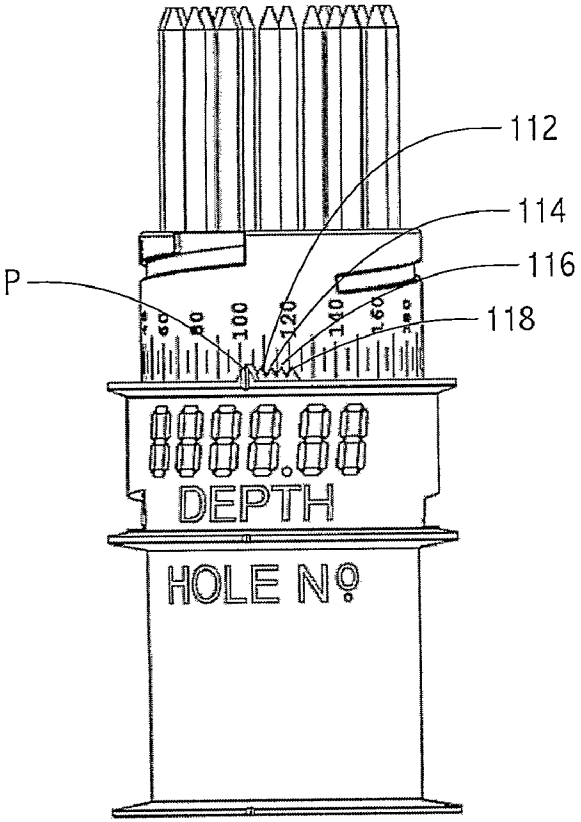

As mentioned before, the scale 48 is marked in 5° increments. In order to accurately locate the 108° mark on the scale 48, the cap 74 is rotated relative to the body 28 so that the main pointer P is on the 5° incremental marking immediately before the desired angle. Thus in this instance, the main pointer P is moved to align with the 105° marking on the scale, as shown in FIG. 11. Each of the minor pointers 112-118 is representative of a 1° increment. As the main pointer is at 105°, but the desired angle is 108°, the third of the minor pointers, 116 is now used in the angle finding process. The cap 74 is now rotated relative to the body 28 so that the third pointer 116 is aligned with its nearest highest scale marking, which is the 120° mark, as shown in FIG. 13. This completes the angle finding process as the major pointer P is now pointing on the bearing scale 48 at the angle provided by the digital orientator 20, namely to 108°.

The template 122 can now be used to draw a line along the outer surface 50 of the body 28 and the core sample 46 in the same manner as described herein above in relation to FIG. 4. In this instance however, the line 126 on the template 122 is aligned with the markings 102, 104 and 106 on the cap 74. Once the core sample 46 (and if preferred the outer surface 50) has/have been marked, the cap 74 can be decoupled from the second end 34 of the body 28 and recoupled to the first end 30 by engagement of the thread sections 94 with the helical thread 52. This can now act as a core block in a similar manner as described above being retained with corresponding core sample 46.

Figure 17:
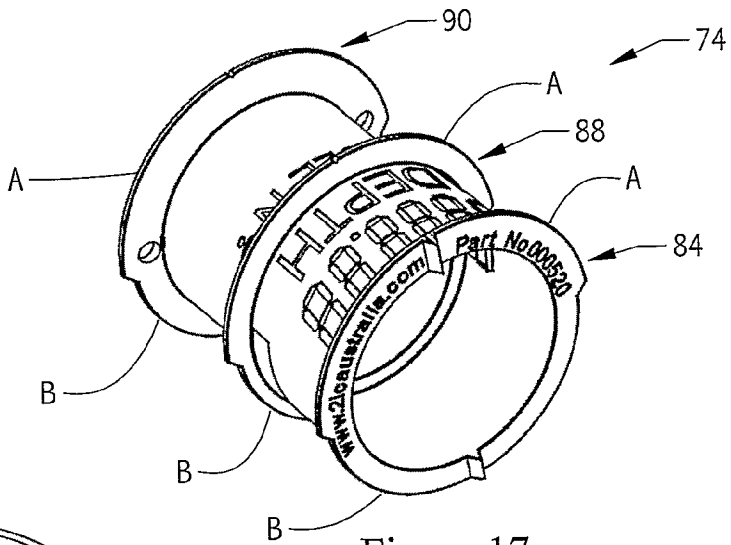

Now that an embodiment of the present invention has been described in detail, it will be apparent to those skilled in the relevant arts that numerous modifications and variations may be made without departing from the basic inventive concepts. For example, the present embodiment depicts the core face profile recording system 41 as a set of pins 42 however other profile recording/marking systems can be used, such as a pad of plasticene. Also the thread 52 and groove 54 can be made of the same configuration (either both a thread or both a groove). In a further variation as shown in FIG. 17 the flanges 84, 88 and 90 may be formed in two semi-circular sections of different radius, for example, a first semi-circular section A (ie spanning 180° degrees) of a radius equal to the radius of a core cut by a standard NQ core drill and a second continuous semi-circular section B of a radius equal to the radius of a core cut by a standard NQ2 core drill. In addition instead of a snap fit coupling of the head 12 to the tool 10, alternate coupling systems may be used such as mating screw threads on the head 12 and the shaft 22 of the tool 10. Further in various forms or embodiments of the invention the body may be made a metallic material or indeed a combination of metallic and non metallic materials. In the event that metallic materials are used for the holes 38, resilient bands such as rubber O-rings may be required to act against the pins 42. Also the keyway 26 and key 121 are interchangeable so that a keyway is formed on the head 12 and a key on the tool 10. All such modifications and variations are deemed to be within the scope of the present invention, the nature of which is to be determined by the above description.

The claims defining the invention are as follows:

1. A core orientation head comprising:

a body made of non-metallic material; and a bearing scale marked on an outer circumferential surface of the body.

2. The core orientation head according to claim 1 further comprising a core face profile recording system carried by the body and adapted to record a profile of a face of a core.

3. The core orientation head according to claim 2 wherein the core face profile recording system comprises:

a plurality of holes that open onto a first end of the body, the holes extending in a direction parallel to a longitudinal axis of the body; and, a plurality of pins which are slidably retained with an interference fit in respective holes.

4. The core orientation head according to claim 1 further comprising a cap having a closed end and an opened end, the cap defining a cavity for receiving a portion of the body, the cap demountably connectable to either of the first and second ends of the body.

5. The core orientation head according to claim 4 wherein the body is provided with a first coupling mechanism at the first end of the body, and a second coupling mechanism at the second end of the body, and the cap is provided with third coupling mechanisms, the cap being demountably connectable to the first end of the body by engagement of the first and third coupling mechanisms, and demountable connectable to the second end of the body by engagement of the second and third coupling mechanisms.

6. The core orientation head according to claim 4 wherein the cap is provided with a vernier scale.

7. The core orientation head according to claim 6 wherein the vernier scale comprises a first major pointer and a series of mutually adjacent minor pointers.

8. The core orientation head according to claim 7 wherein the pointers are rotationally spaced to provide a 1° resolution of the bearing scale.

9. The core orientation head according to claim 1 further comprising an integrally formed releasable connector whereby the core orientation head can be releasably connected to an orientation tool.

10. The core orientation head according to claim 9 wherein the releasable connector comprises a plurality of resilient fingers.

11. The core orientation head according to claim 9 further comprising a rotational reference mechanism whereby the head is releasably coupled in a known rotational relationship to an orientation tool.

12. The core orientation head according to claim 11 wherein the rotational reference mechanism comprises one of a key and a keyway formed on the head for engaging a corresponding one of a keyway and a key provided on the orientation tool.

13. The core orientation head according to claim 1 wherein the body is provided with a first coupling mechanism at the first end of the body, and a second coupling mechanism at the second end of the body, and the cap is provided with third coupling mechanisms, the cap being demountably connectable to the first end of the body by engagement of the first and third coupling mechanisms, and demountable connectable to the second end of the body by engagement of the second and third coupling mechanisms.

14. A core orientation head comprising:

a body having first and second ends, an outer circumferential surface;

a bearing scale marked on the outer circumferential surface; and a core face profile recording system carried by the body and adapted to record a profile of a face of a core.

15. The core orientation head according to claim 14 wherein the body is made at least partially of a non-metallic material.

16. The core orientation head according to claim 14 wherein the core face profile recording system comprises:

a plurality of holes formed in the body which open onto the first end of the body, the holes extending in a direction parallel to a longitudinal axis of the body; and a plurality of pins which are slidably retained with an interference fit in respective holes.

17. The core orientation head according to claim 14 further comprising:

a cap having a closed end and an opened end, the cap defining a cavity for receiving a portion of the body, the cap demountable connectable to either of the first end or the second end of the body.

18. The core orientation head according to claim 17 where the body is provided with a first coupling mechanism at the first end of the body, and a second coupling mechanism at the second end of the body, and the cap is provided with third coupling mechanisms, the cap being demountably connectable to the first end of the body by engagement of the first and third coupling mechanisms, and demountably connectable to the second end of the body by engagement of the second and third coupling mechanisms.

19. The core orientation head according to claim 17, wherein the cap is provided with a vernier scale.

20. The core orientation head according to claim 19 wherein the vernier scale comprises a first major pointer and a series of mutually adjacent minor pointers.

21. The core orientation head according to claim 20 wherein the pointers are rotationally spaced to provide a 1° resolution of the bearing scale.

22. A core orientation head comprising:

a body having first and second ends and being made of non-metallic material, the body provided with a plurality of holes that open onto the first end of the body, the holes extending in a direction parallel to a longitudinal axis of the body;

a plurality of pins which are slidably retained with an interference fit in respective holes;

and, wherein the body comprises an outer circumferential surface, the outer circumferential surface marked with a bearing scale.

23. The core orientation head according to claim 22 further comprising:

a cap having a closed end and an opened end, the cap defining a cavity for receiving a portion of the body, the cap demountable connectable to either of the first end or the second end of the body.

24. The core orientation head according to claim 23 wherein the cap is provided with a vernier scale.

25. The core orientation head according to claim 24 wherein the vernier scale comprises a first major pointer and a series of mutually adjacent minor pointers.

26. The core orientation head according to claim 25 wherein the pointers are rotationally spaced to provide a 1° resolution of the bearing scale.

27. A core orientation head comprising:

a body having first and second opposite ends, and a core face profile recording device at the first end; and, a cap having a closed end and an opened end, the cap defining a cavity for receiving a portion of the body, the cap demountably connectable to either of the first and second ends of the body, wherein the body is provided with a first coupling mechanism at the first end of the body, and a second coupling mechanism at the second end of the body, and the cap is provided with third coupling mechanisms, the cap being demountably connectable to the first end of the body by engagement of the first and third coupling mechanisms, and demountably connectable to the second end of the body by engagement of the second and third coupling mechanisms.

28. A core orientation head comprising:

a cylindrical body made of non-metallic material having axially opposed first and second ends; and a cap having a closed end and an opened end, the cap defining a cavity for receiving a portion of the body, the cap being demountably connectable to the body in first and second configurations, wherein in the first configuration, the first end of the body is received in the open end of the cap, and the closed end of the cap faces the first end of the body, and wherein in the second configuration, the second end of the body is received in the open end of the cap, and the closed end of the cap faces the second end of the body.

29. The core orientation head according to claim 28 further comprising a core face profile recording system carried by the body and adapted to record a profile of a face of a core.

30. The core orientation head according to claim 29 wherein the core face profile recording system comprises a plurality of holes that open onto a first end of the body, the holes extending in a direction parallel to a longitudinal axis of the body; and a plurality of pins which are slidably retained with an interference fit in respective holes.

31. The core orientation head according to claim 28 wherein the cap is provided with a vernier scale.

32. The core orientation head according to claim 31 wherein the vernier scale comprises a first major pointer and a series of mutually adjacent minor pointers.

33. The core orientation head according to claim 32 wherein the pointers are rotationally to provide a 1° resolution of the bearing scale.

34. The core orientation head according to claim 28 further comprising an integrally formed releasable connector whereby the core orientation head can be releasably connected to an orientation tool.

35. The core orientation head according to claim 34 wherein the releasable connector comprises a plurality of resilient fingers.

36. The core orientation head according to claim 34 further comprising a rotational reference mechanism whereby the head is releasably coupled in a known rotational relationship to an orientation tool.

37. The core orientation head according to claim 36 wherein the rotational reference mechanism comprises a key or a keyway formed on the head for engaging a keyway or a key respectively provided on the orientation tool.

38. A core orientation head for a down hole tool comprising:

a body having first and second ends, the second end having a releasable connector enabling the core orientation head to releasably connect to the down hole tool, an outer circumferential surface, and a bearing scale marked on the outer circumferential surface providing an indication of angular displacement of up to 360 degrees from a reference direction.

39. The core orientation head according to claim 38 wherein the body is made at least partially of a non-metallic material.

40. The core orientation head according to claim 38 further comprising:

a cap having a closed end and an opened end, the cap defining a cavity for receiving a portion of the body, the cap demountable connectable to either of the first end or the second end of the body.

41. The core orientation head according to claim 40 where the body is provided with a first coupling mechanism at the first end of the body, and a second coupling mechanism at the second end of the body, and the cap is provided with third coupling mechanisms, the cap being demountably connectable to the first end of the body by engagement of the first and third coupling mechanisms, and demountably connectable to the second end of the body by engagement of the second and third coupling mechanisms.

42. The core orientation head according to claim 40, wherein the cap is provided with a vernier scale.

43. The core orientation head according to claim 42 wherein the vernier scale comprises a first major pointer and a series of mutually adjacent minor pointers.

44. The core orientation head according to claim 43 wherein the pointers are rotationally spaced to provide a 1° resolution of the bearing scale.

45. A core orientation head comprising:

a body having first and second ends and being made of non-metallic material, the body provided with a plurality of holes that open onto the first end of the body, the holes extending in a direction parallel to a longitudinal axis of the body; and a plurality of pins which are slidably retained within the body, the holes and the pins being relatively dimensional so that an interference fit is created between an inner circumferential surface of the holes and an outer circumferential surface of the respective pins retained in the holes.

46. The core orientation head according to claim 45 wherein the body comprises an outer circumferential surface, the outer circumferential surface marked with a bearing scale.

47. The core orientation head according to claim 46 further comprising:

a cap having a closed end and an opened end, the cap defining a cavity for receiving a portion of the body, the cap demountable connectable to either of the first end or the second end of the body.

48. The core orientation head according to claim 47 wherein the cap is provided with a vernier scale.

49. The core orientation head according to claim 48 wherein the vernier scale comprises a first major pointer and a series of mutually adjacent minor pointers.

50. The core orientation head according to claim 49 wherein the pointers are rotationally spaced to provide a 1° resolution of the bearing scale.

51. A core orientation head comprising:

a cylindrical body having axially opposed first and second ends, and a core face profile recording device at the first end; and a cap having a closed end and an opened end, the cap defining a cavity for receiving a portion of the body, the cap demountably connectable to the body in first and second configurations, wherein in the first configuration, the first end of the body is received in the open end of the cap and the closed end of the cap overlies the core face profile recording device wherein the core face profile recording device is enclosed within the cavity, and wherein in the second configuration, the second end of the body is received within the open end of the cap, the closed end of the cap faces the second end of the body, and the core face profile recording device is exposed.

52. A core orientation head comprising:

a body made of non-metallic material;

a bearing scale marked on an outer circumferential surface of the body;

a cap having a closed end and an opened end, the cap defining a cavity for receiving a portion of the body, the cap demountably connectable to either of the first and second ends of the body;

wherein the body is provided with a first coupling mechanism at the first end of the body, and a second coupling mechanism at the second end of the body, and the cap is provided with third coupling mechanisms, the cap being demountably connectable to the first end of the body by engagement of the first and third coupling mechanisms, and demountable connectable to the second end of the body by engagement of the second and third coupling mechanisms.

53. The core orientation head according to claim 52 further comprising a core face profile recording system carried by the body and adapted to record a profile of a face of a core.

54. The core orientation head according to claim 52 wherein the core face profile recording system comprises:

a plurality of holes that open onto a first end of the body, the holes extending in a direction parallel to a longitudinal axis of the body; and a plurality of pins which are slidably retained with an interference fit in respective holes.

55. The core orientation head according to claim 52 wherein the cap is provided with a vernier scale.

56. The core orientation head according to claim 55 wherein the vernier scale comprises a first major pointer and a series of mutually adjacent minor pointers.

57. A core orientation head comprising:

a body having first and second ends, an outer circumferential surface;

a bearing scale marked on the outer circumferential surface;

a core face profile recording system carried by the body and adapted to record a profile of a face of a core; and a cap having a closed end and an opened end, the cap defining a cavity for receiving a portion of the body, the cap demountable connectable to either of the first end or the second end of the body, wherein the body is provided with a first coupling mechanism at the first end of the body, and a second coupling mechanism at the second end of the body, and the cap is provided with third coupling mechanisms, the cap being demountably connectable to the first end of the body by engagement of the first and third coupling mechanisms, and demountably connectable to the second end of the body by engagement of the second and third coupling mechanisms.

58. The core orientation head according to claim 57 wherein the core face profile recording system comprises:

a plurality of holes formed in the body which open onto the first end of the body, the holes extending in a direction parallel to a longitudinal axis of the body; and a plurality of pins which are slidably retained with an interference fit in respective holes.

59. A core orientation head comprising:

a body having first and second ends and being made of non-metallic material, the body provided with a plurality of holes that open onto the first end of the body, the holes extending in a direction parallel to a longitudinal axis of the body;

a plurality of pins which are slidably retained with an interference fit in respective holes;

wherein the body comprises an outer circumferential surface, the outer circumferential surface marked with a bearing scale; and a cap having a closed end and an opened end, the cap defining a cavity for receiving a portion of the body, the cap demountable connectable to either of the first end or the second end of the body, wherein the cap is provided with a vernier scale.

60. A core orientation head comprising:

a body made of non-metallic material;

a bearing scale marked on an outer circumferential surface of the body; and an integrally formed releasable connector whereby the core orientation head can be releasably connected to an orientation tool.

61. The core orientation head according to claim 60 wherein the releasable connector comprises a plurality of resilient fingers.

62. The core orientation head according to claim 60 further comprising a rotational reference mechanism whereby the head is releasably coupled in a known rotational relationship to an orientation tool.

63. The core orientation head according to claim 62 wherein the rotational reference mechanism comprises one of a key and a keyway formed on the head for engaging a corresponding one of a keyway and a key provided on the orientation tool.

64. A core orientation head comprising:

a body having first and second opposite ends, and a core face profile recording device at the first end; and, a cap having a closed end and an opened end, the cap defining a cavity for receiving a portion of the body, the cap demountably connectable to either of the first and second ends of the body;

wherein the body is provided with a first coupling mechanism at the first end of the body, and a second coupling mechanism at the second end of the body, and the cap is provided with third coupling mechanisms, the cap being demountably connectable to the first end of the body by engagement of the first and third coupling mechanisms, and demountably connectable to the second end of the body by engagement of the second and third coupling mechanisms; and an integrally formed releasable connector whereby the core orientation head can be releasably connected to an orientation tool.

65. The core orientation head according to claim 64 wherein the releasable connector comprises a plurality of resilient fingers.

66. The core orientation head according to claim 64 further comprising a rotational reference mechanism whereby the head is releasably coupled in a known rotational relationship to an orientation tool.

67. The core orientation head according to claim 66 wherein the rotational reference mechanism comprises one of a key and a keyway formed on the head for engaging a corresponding one of a keyway and a key provided on the orientation tool.

* * * * *